United States Patent [19]

Marin

[11] Patent Number: 4,683,733

[45] Date of Patent: Aug. 4, 1987

[54] DOOR LOCK

[76] Inventor: Manuel Marin, 9060A Copernic St., Saint-Léorard, H1R 3M4, Québec, Canada

[21] Appl. No.: 835,875

[22] Filed: Mar. 3, 1986

[51] Int. Cl.[4] ..... E05B 65/06

[52] U.S. Cl. ..... 70/134; 70/379; 70/380; 292/8

[58] Field of Search ..... 292/173, 174, 161, 5–7, 292/8; 70/379 R, 380, 134

[56] References Cited

U.S. PATENT DOCUMENTS

| | | | |
|---|---|---|---|
| 340,620 | 4/1886 | Russell | 70/134 |
| 2,129,967 | 9/1938 | Rubner | 70/379 R |
| 2,379,050 | 6/1945 | Voight | 292/5 |
| 2,842,951 | 7/1958 | Duvall | 70/379 R |
| 3,464,242 | 9/1969 | Torii | 70/134 |
| 4,028,917 | 6/1977 | Schlage | 70/134 |
| 4,261,602 | 4/1981 | Anderson | 292/143 |

FOREIGN PATENT DOCUMENTS

| | | | |
|---|---|---|---|
| 2006649 | 9/1971 | Fed. Rep. of Germany | 70/380 |
| 510011 | 1/1955 | Italy | 292/8 |
| 32795 | 3/1977 | Japan | 70/380 |

*Primary Examiner*—Henry E. Raduazo

[57] ABSTRACT

A door locking mechanism enclosed within a casing for locking a door to its door frame. The door lock includes at least one bolt displaceable inside the casing through a bore in a side wall thereof, to engage a registering bore in the door frame. A base leg is fixed to the rear of the bolt, and includes a Y-shaped notch. A conventional keylock cylinder is fixed within the casing, and a key operated barrel is journalled within the cylinder and offset from the center of the latter and has a radially-outwardly-projecting lug. An annular member is rotatably mounted around the keylock cylinder between two opposite casing walls, and includes an inner projection and an outer operating arm which engages the Y-shaped notch of the base leg. Upon rotation of the barrel by the key, the barrel lug comes to abut against the inner projection of the annular member to thereafter bring the annular member in rotation therewith, so that the outer operating arm frictionally sweeps the Y-shaped notch to displace the base leg, and thus the bolt between door locking and unlocking positions. The bolt is locked by the operating arm in either position.

7 Claims, 19 Drawing Figures

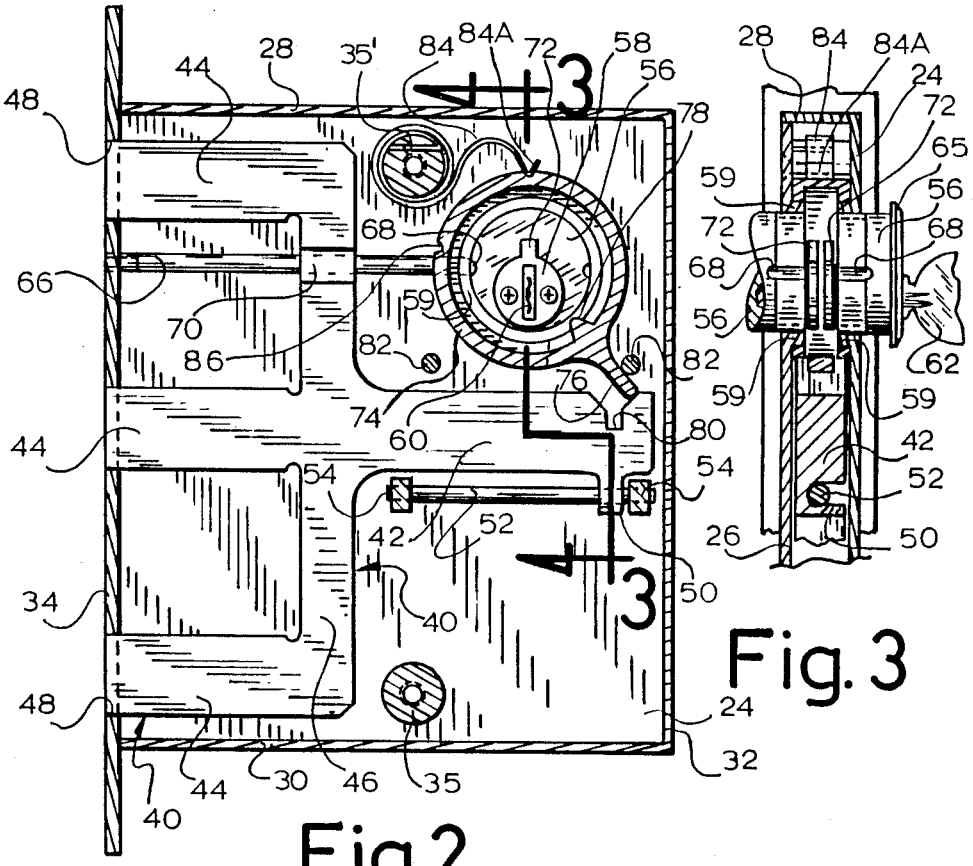
Fig. 3
Fig. 2
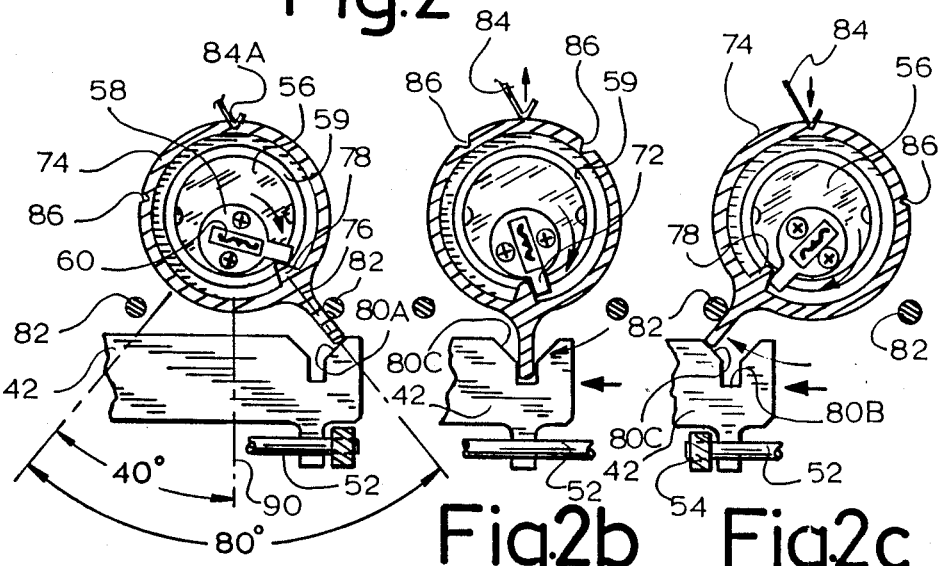
Fig.2a Fig.2b Fig.2c 100
102
122
120
126
128
124
136
134
35
35a
84
72
58
74
56
78
82
76
80
132
110
66
114
104
118
116
112
108
106
150
184
154
140
141
146
148
152
158
142
139
52
54
144
168
166
156
160
162
164
176
172
178
170
138
122
120
132
114
5
14
118
150
158
139
140
156
170
176
136
162
160
138
118
134
132

172
180
138
178
170
182
174

DOOR LOCK

FIELD OF THE INVENTION

This invention relates to key operated lock devices, especially those lock devices for doors.

PRIOR ART

The square bolt of certain conventional key operated door locks are positively maintained in projecting door locking position after rotation of the barrel through one-half turn and removal of the key. This is an important safety feature. However complicated and bulky mechanism is required for this purpose. Such locks, for instance, cannot be accomodated in the sash of a patio door.

OBJECTS OF THE INVENTION

The object of the present invention is to provide a very sturdy door lock device which has the above self-locking bolt feature and yet which is compact, simple to make and assemble and which is easily operated.

A further object of the invention is to provide the above lock device, having the further characteristic of multiple locking back-up features in case the main locking member fails or is rendered ineffective by unauthorized means and, as such, is an improvement over applicant's prior U.S. Pat. No. 4,435,921.

SUMMARY OF THE INVENTION

There is provided a door locking device of the key operated type, used in combination with a conventional key lock cylinder and key operated barrel, radially offset from and rotatable in the cylinder and having an actuating radial lug, at its end opposite the key receiving slit. The device includes an annular member rotatably mounted around said keylock cylinder and includes an inner projection and an outer radial operating arm. A door locking bolt is guided for linear movement and has a base leg with a a Y-notch engaged by the operating arm to displace the bolt between door locking and unlocking positions, the annular member being rotated by the lug of the rotating barrel which abuts the inner projection. In at least door locking position of the bolt, the operating arm is substantially normal to the side of the Y-notch and therefore prevents bolt retraction, yet the barrel can be rotated back one half turn for key removal. The bolt can have several integral prongs. The bolt can be used in combination with a new system of hooking bolts and this system is designed to lock the handle operated door latch in door locking position when the bolt is also in door locking position.

BRIEF DESCRIPTION OF THE DRAWINGS

FIG. 2 is a vertical sectional view taken along line 2—2 of FIG. 1;

FIGS. 2*a* to 2*c* are partial views of FIG. 2, sequentially showing how the annular member moves the bolt from retracted to projecting door locking position;

FIG. 3 is a cross-sectional view taken along the line 3—3 of FIG. 2, with the operating key shown partly broken;

DETAILED DESCRIPTION OF THE PREFERRED EMBODIMENTS

Figure 1:
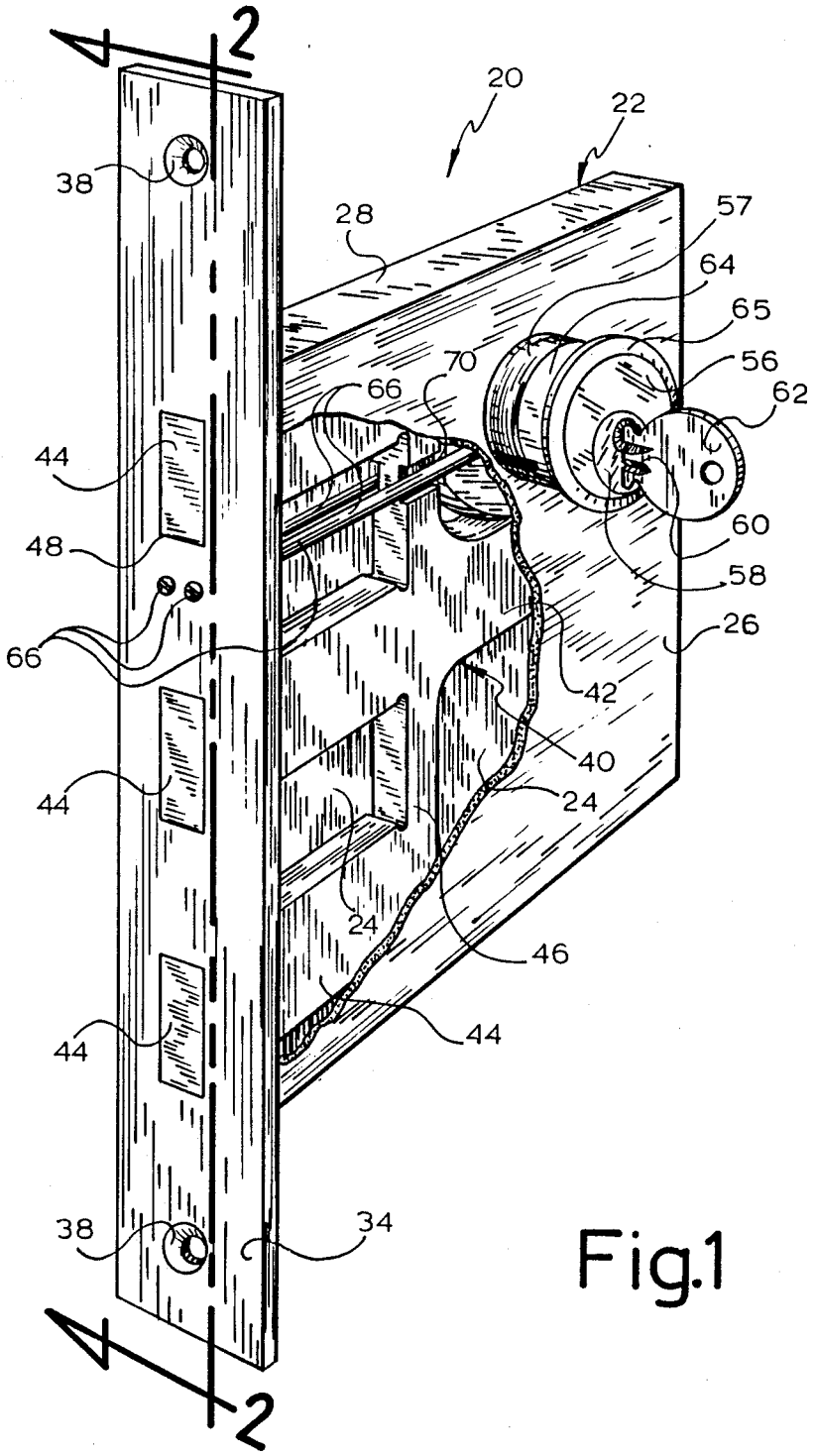
FIG. 1 is a frontward perspective view of a released door lock assembly and of the operating key according to the first embodiment of the invention, with the casing thereof being partly broken.

In FIGS. 1, 2 and 3, there is shown the door lock device 20 according to a first embodiment of the invention. Device 20 comprises a metal casing 22 defining two main parallel walls 24, 26, and two pairs of opposite peripheral walls 28, 30 and 32, 34. Inner spacer members 35 are also used in between walls 24 and 26. Wall 26 forms a removable closure secured by bolts through spacer members 35. Walls 28, 30, and 32, are similar, but wall 34 is much larger and longer to constitute a guard plate 34 projecting beyond both walls 28 and 30. Casing 22 is conventionally inserted within a door with guard plate 34 secured to the edge by screws, not shown inserted into frusto-conical holes 38. A three-prong forked, bolt member 40 is within casing 22 and defines a base leg 42 and three spaced prongs or bolts 44, interconnected by a transverse link 46. The leg 42 and bolts 44 are substantially parallel to walls 28–30. The bolts 44 are square with their end face normal to base leg 42 and flush with the outer face of guard plate 34 when bolts 44 are retracted. Bolts 44 are slidable through registering openings 48 in guard plate 34. Leg 42 comprises an inner transverse concave ear 50, near wall 32 and extending toward wall 30. Ear 50 slidingly engages a horizontal guide rod 52 which is removably secured in end brackets 54 secured to wall 24, rod 52 extending parallel to walls 28 and 30 and adjacent leg 42 on the side of wall 30. Bolt member 40 is guided for linear movement by guide rod 52 and openings 48.

Two conventional keylock cylinders 56, having intermediate exterior threads 57, are screwed in an annular flange 59 of walls 24 and 26 respectively near the corner defined by walls 28 and 32. There are thus two coaxial cylinders 56 (FIG. 3). A conventional cylindrical lock barrel 58 is rotatably and eccentrically mounted into each cylinder 56, and includes the conventional front key slit 60 engageable by a conventional key 62. Each cylinder 56 has an outermost portion 64, provided with an integral abutment flange 65 to abut the door main face. Each cylinder 56 is locked against rotation by a long bolt 66 screwed in guard plate 34 and in annular flange 59 and engaging a groove 68 in cylinder 56. Link 46 has opposite grooves 70 to clear set bolts 66.

Each rotatable barrel 58 carries at its inner end a radially projecting lug 72, the two lugs 72 adjacent each other (FIG. 3). Barrel 58 is radially offset from the center of cylinder 56, whereby rotation of barrel 58 eventually brings lug 72 radially-outwardly of the periphery of cylinder 56.

According to an essential feature of the invention, there is provided within casing 22 and around cylinder 56 a rotatable annular member 74 of U-shaped cross-section which slidably fits around annular flanges 59. Annular member 74 has a long radially-outer operating arm 76 and a short radially-inturned projection 78. The latter is preferably although not necessarily aligned with projection 76, passing along a straight line extending through the center of cylinder 56. Annular member 74 preferably has a thinner arcuate portion 74A, see FIG. 8, for clearing set bolts 66. Portion 74A can be completely removed as shown in FIG. 9. The outer operating arm 76 engages a Y-shaped notch 80 made at the free end portion of the base leg 42 of the bolt member 40.

Advantageously, there are provided two spaced stop rods 82, fixed to wall 24, adjacent leg 42 and along an imaginary circle concentric to cylinder 56 but larger than annular member 74. Arm 76 abuts stop rods 82 in its respective limit rotated positions. Coiled around the spacer member 35' closer to annular member 74, is a leaf spring 84 fixed to member 35' and which has a free end portion 84A biased against the periphery of annular member 74. Two spaced notches 86 at the periphery of annular member 74, are alternately engageable by the leaf spring free end 84A upon rotation of said annular member 74 to resiliently maintain the latter in either one of its two limit positions.

In the barrel position of FIG. 2 key 62 can be inserted into or removed from barrel 58. In this position, bolt member 40 is in retracted position and locked in this position because operating arm 76 abuts against and is substantially normal to inclined side 80A of Y-shaped notch 80. To advance bolt member to door locking position, barrel 58 is first rotated clockwise, by key 62 for a 120 degree angle approximately, from its position of FIG. 2 to that of FIG. 2*a*. Barrel lug 72 then abuts against inturned projection 78.

The second step is the sequence shown in FIGS. 2*a*–2*c*. Key 62 continues to rotate barrel 58 clockwise, for about a further 80 degrees, whereby lug 72 causes concurrent rotation of projection 78 and thus of annular member 74. Arm 76 slides inwardly along notch side 80A, engages into an apex cavity 80B of Y-shaped notch 80 to move bolt member 40 out of guard plate 34 until arm 76 abuts and is substantially normal to the opposite side 80C of Y-notch 80. Arm 76 then abuts against stop rod 82B, which prevents any further movement thereof. Leaf spring 84 then engages a notch 86 to resiliently immobilize annular member 74. Barrel 58 is rotated back to the position of FIG. 2 to release key 62.

Counterclockwise rotation of barrel 58 through 120° will cause bolt member 40 to slide back to its door unlocking position.

Sides 80A and 80C of the Y-notch 80 are substantially symmetrical, because the middle position of the sweeping arc made by the annular member arm 76 lies on a line 90 passing through the rotation centers of annular member 74, and of barrel lug 72, (see FIG. 2*a*).

It is envisioned that the number of prongs 44 of the bolt member 40 may vary, preferably between one and five. Also, spacers 35 may be made of elastomeric material.

FIGS. 4 to 8 show the second embodiment of the invention, lock device 100. Device 100 is enclosed within a casing 102, itself mounted in a door (not shown). A single bolt 104 is slidable within the casing 102, and includes a base leg 106, and a square and face 108 flush with side wall 110 in the retracted position of bolt 104 and engaging a hole 112 of door frame 114 in the door locking position. The manner in which the bolt 104 is to be displaced within casing 102 is the same as in the first embodiment, with operating arm 76 of annular member 74 engaging Y-shaped notch 80 at the inner end of base leg 106. The only difference is that the leaf spring 84 is attached to a stud 35*a* instead of spacer 35'.

Figure 4A:
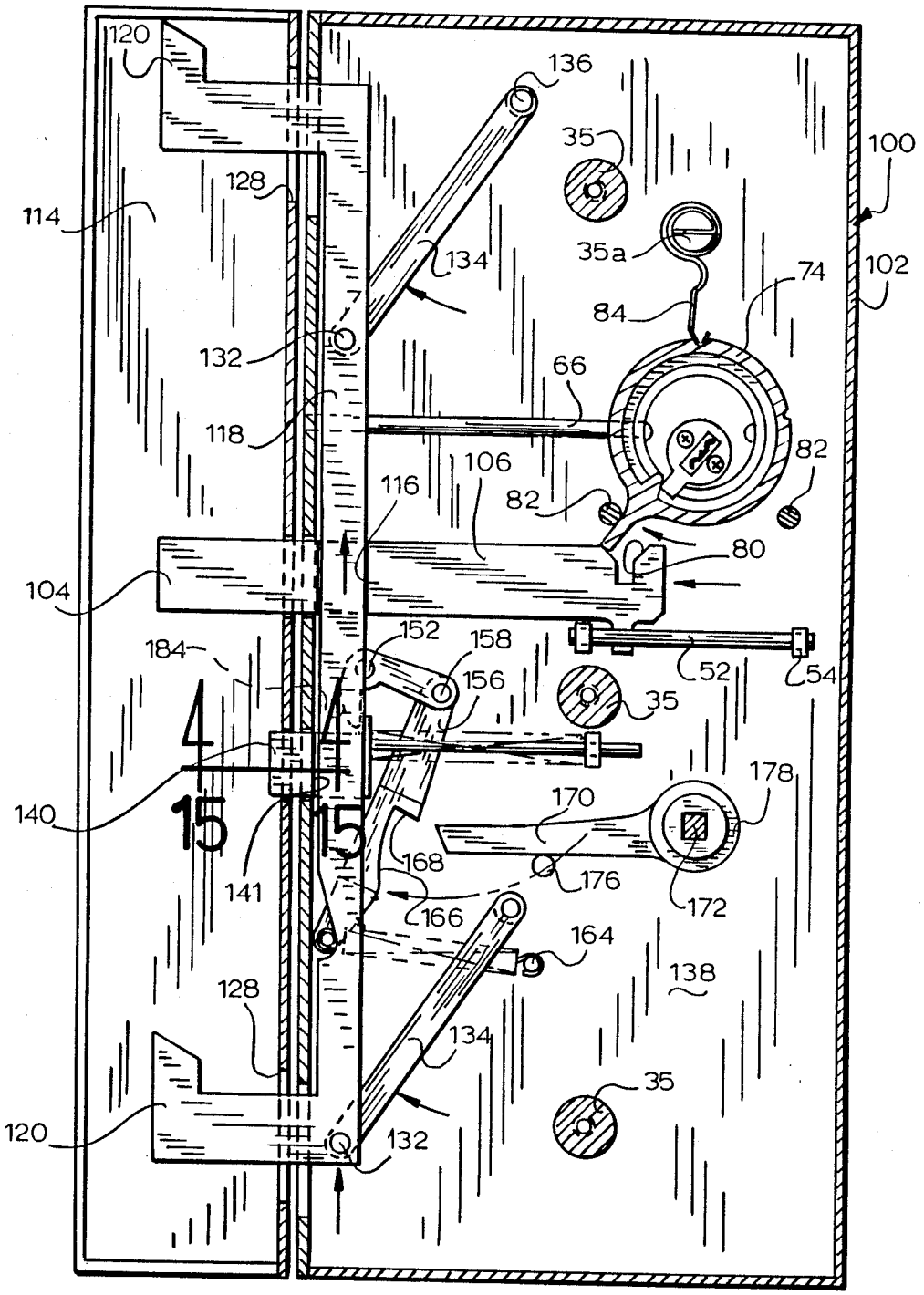
FIG. 4*a* is the view of FIG. 4 but with the door lock being in its door locking position.

Bolt 104 has an intermediate groove 116 slidably engaged by a transverse link 118 terminated at its two ends by integral hook bolts 120, each having a bevelled end face 122 and an outer face 124. In the retracted position of bolt 104, outer faces 124 are flush with side wall 110 and in the door locking position of bolt 104, (see FIG. 4*a*), inner face 126 of each bolt 104 overlaps the top edge of door frame opening 128, through which each bolt 104 extends within door frame 114. Thus the door cannot be pulled out even if its hinge pins are removed.

When bolt 104 slides horizontally transversely of side wall 102, so do hook bolts 120 but bolts 120 are also vertically slidable along an axis parallel to wall 102. Bolts 120 slide vertically with the displacement of link member 118, because the latter is pivotally connected at its opposite ends at pivots 132 to one end of two parallelogram linkages 134 having their other end pivoted by pivots 136 to rear wall 138 of casing 102. When bolts 104, 120, are fully engaged in the registering door frame openings 112, 128, hook bolts 120 cannot be removed as by pulling the door out of the frame 130.

The locking mechanism further includes means to disconnect the door handle operated door latch from the handle in the door locking position of the bolts so as to use the latch as an additional door locking means.

There is provided a second guide rod 139 parallel to guide rod 52, secured at its outer end to a door latch 140 and slidably engaged at its inner end to a braket 142 mounted to rear wall 138. The free end of latch 140 is transversely bevelled, as is common in the art.

A compression coil spring 144 surrounds guide rod 139 and abuts latch 140 and bracket 142 to bias latch 140 into corresponding openings 146 and 148 in wall 110 and door frame 114, independently of the position of link 118. Thus, latch 140 is in its engaged operative position, when bolt 104 is in either its released and engaged positions.

For releasing latch 140, there is provided a hook lever 150 pivotally mounted at 142 on rear wall 138 and engaging a latch tab 154 laterally protruding from the rear end of latch 140. A notched lever 156 is pivoted at 158 to the inner end of hook lever 150 and the opposite end of notched lever 156 carries a stud 160 to which is attached a tension spring 162 the other end of which is attached to a pin 164 fixed to casing rear wall 138. Notched lever 156 clears link member 118 except its stud 160 which is engageable in a notch 164 of link member 118. Lever 156 has along its inner side a notch 166 defining a downwardly facing step 168 engageable by the free end of an actuating arm 170 rotatably fixed to the conventional cross-sectionally square, handle axle 172 of a door knob or handle (not shown). Axle 172 (see FIG. 14) is spring biased by a spiral spring 174 to a position in which actuating arm 170 abuts a stop 136 fixed to casing rear wall 138. The enlarged end 178 of arm 170 has journal flanges 180 rotatably engaging a hole in rear wall 138 and in removable closure wall 182 of the casing 102. Spiral spring 174 is fixed to enlarged arm end 178 and to closure wall 182.

Figures 4, 5, 14:
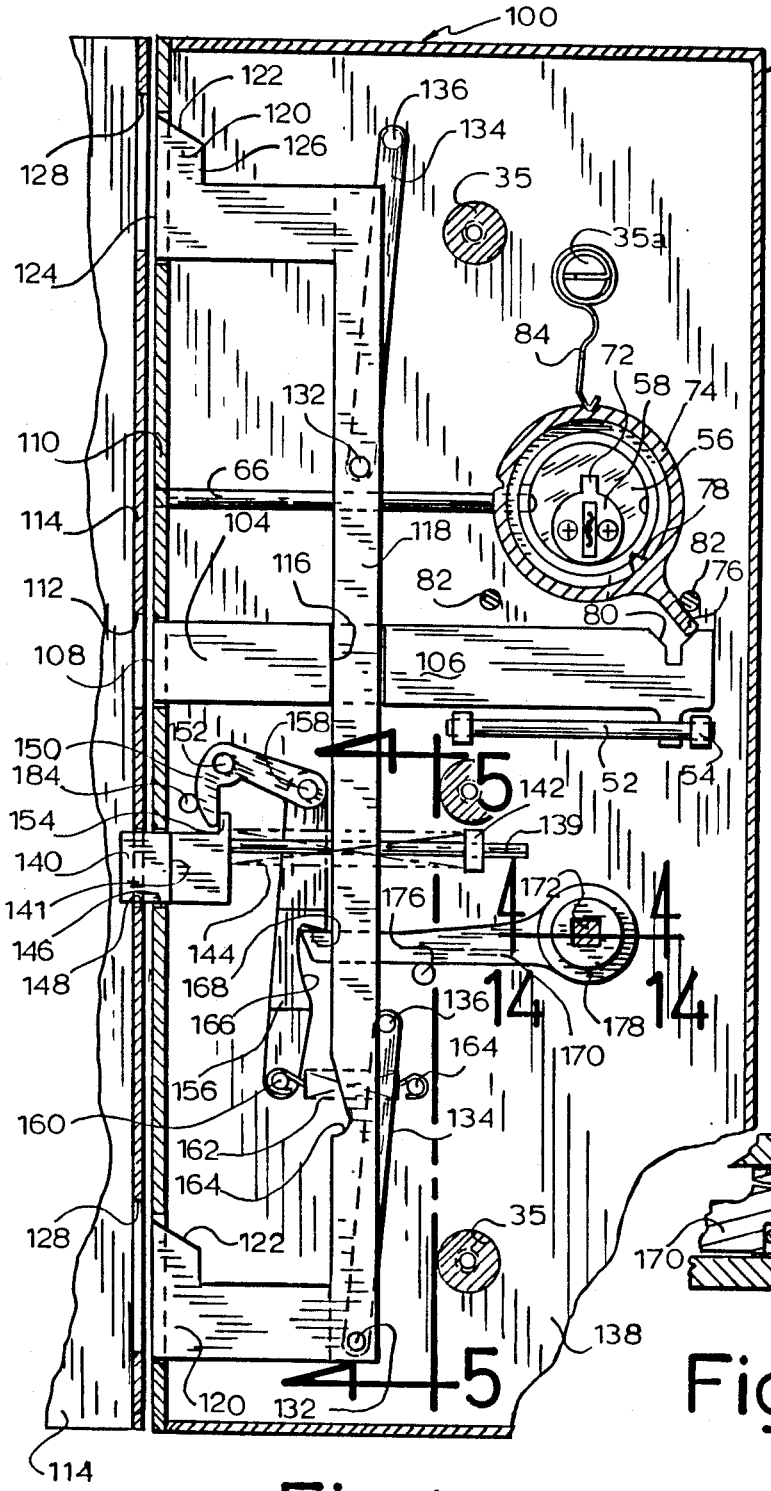
FIG. 4 is a vertical sectional view of a partly broken door, the door lock being in its released position, and the door latch in its engaged position.
FIG. 5 is a vertical sectional view taken along line 5—5 of FIG. 4.
FIG. 14 is a cross-sectional view taken along line 14—14 of FIG. 4.
Figure 6:
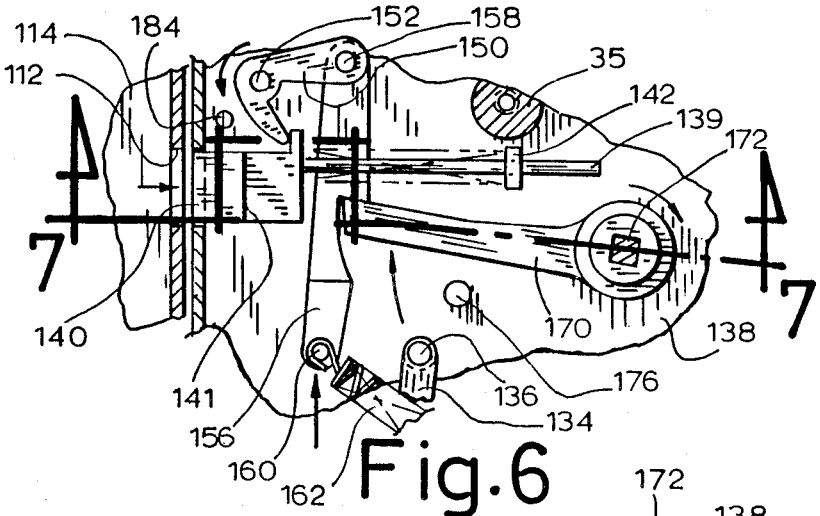
FIG. 6 is a vertical sectional fragmented view of the door lock of FIG. 4, but with the door latch in its release position, the main vertical link member being removed for clarity.
Figure 7:
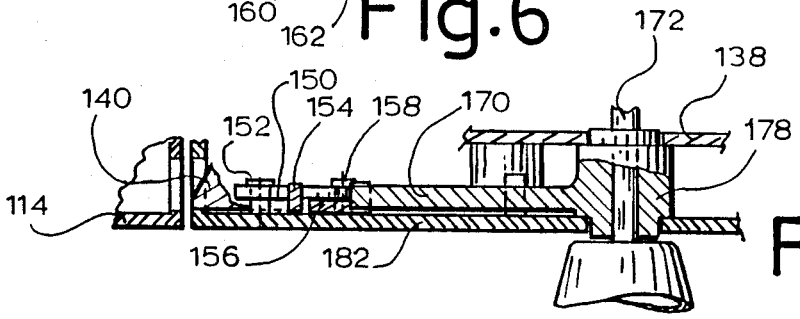
FIG. 7 is a cross-sectional view taken along the broken line 7—7 of FIG. 6.

Referring to FIGS. 4 and 6, when the bolts 104, 120 are in retracted position, the notched lever 156 is biased inwardly by tension spring 162 to a position in which the outer end of actuating arm 170 engages notch of 166 of lever 156. Rotation of the door know in a direction to lift actuating arm 170 off stop 176 causes lifting of notched lever 156 against the bias of tension spring 162 and lever 156 rotates hooked lever 150 which retracts latch 140 to allow door opening movement (FIG. 6). Upon release of the door knob, hooked lever 150 returns to its rest position (FIG. 4) in which it abuts a stop 184 fixed to casing wall 138. During key operated advancing movement of bolt 104 and consequently of link member 118 from the retracted position (FIG. 4) to the advanced, door locking position of FIG. 4*a*, notched lever 156 pivots outwardly about top pivot 158 and clears the outer end of actuating arm 170 because stub 160 carried by lever 156 is advanced by link 118. Thus the door knob has no longer any retracting action on latch 140. Also the latter is positively maintained in advanced position because its rearwardly facing step 141 abuts the advanced link 118.

The third embodiment indicated at 190 is shown in FIGS. 9 to 13 and should be compared to the first embodiment. It is modified to be mounted in a patio door hollow sash 192 which has a very restricted space. The inner wall 194 of sash 192 has means to mount glass panes (not shown). Locking device 190 includes a casing 196 inserted through a sash opening 193 and retained within sash 192 by bolts 198. A guard plate 195 closes sash opening 193 and is secured to casing 196 by bolts 198'. Two lock cylinders 56 are mounted in casing 196 and through sash 192 in opposite fashion with the operating lugs 72 of barrels 58 close to each other for selectively engaging the inner projection 78*a* of modified annular member, 74*a* (FIG. 9) which slidably rotates on cylinder receiving annular flanges 59*a* of casing 196.

Member 74*a* has a central peripheral through slot 200 for the passage of the two lugs 32 and this slot corresponds to the channel formed in member 74 of the first embodiment which is of U-shaped cross-section.

Figure 8:
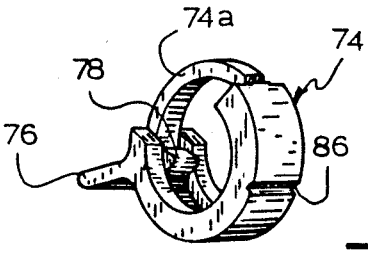
FIG. 8 is a perspective view of the lock device annular member used in either of the first or second embodiments.
Figure 10:
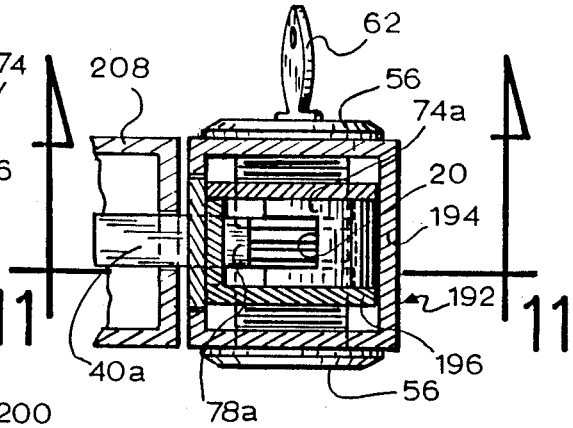
FIG. 10 is a sectional cross-view of the sash of a patio door, showing a door lock according to the third embodiment of the invention with the bolt engaging into a door frame, and further showing the operating key, this view taken along line 10—10 of FIG. 11.
Figure 9:
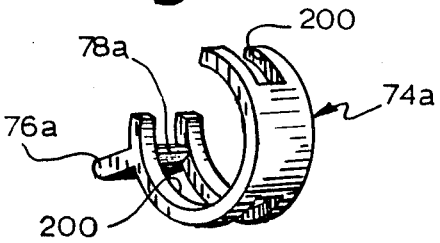
FIG. 9 is a perspective of another embodiment of the annular member.

Member 74*a* does not form a complete ring but the portion 74A of FIG. 8 is removed—yet member 74*a* extends through more than 180° to be rotatably retained on flanges 59*a*. This cut out clears the two set screws 66*a* which are screwed within sash 192 to retain the two cylinders 56 against rotation. The casing 196 has an opening 202 around set screws 66*a* adjacent sash outer wall 204 to accomodate the lock device within the sash 192. For a similar reason, casing 196 also has an opposite opening 206 adjacent sash inner wall 194. The external operating arm 76*a* of member 74*a* engages a Y-shaped notch 80*a* of a bolt 40*a* which is guided for linear movement by bolt opening 48*a* and by a guide rod 52*a* engaging an arcuate ear 50*a* laterally protruding from the inner end of bolt 40*a*.

Figure 11:
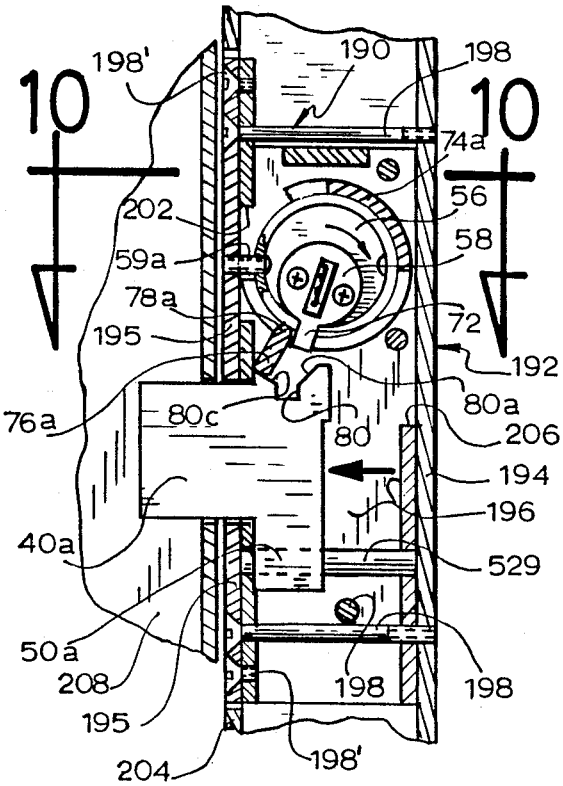
FIG. 11 is a fragmented vertical section view of a patio door sash with the bolt in its door locking position within the door frame, said view taken along line 11—11 of FIG. 10.
Figure 12:
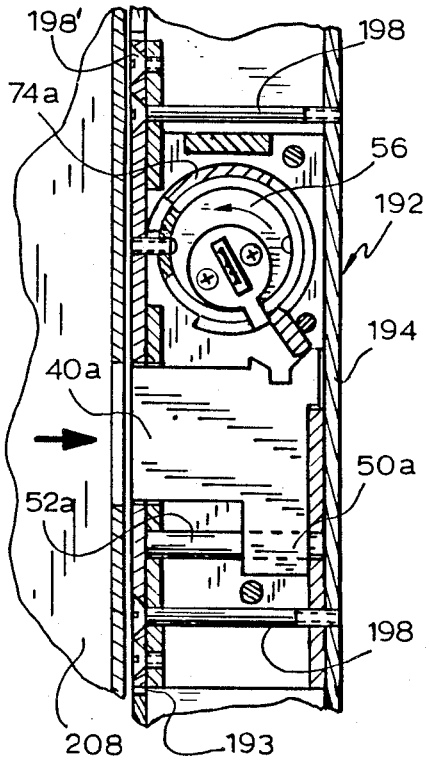
FIG. 12 is the view of FIG. 11 but with the bolt in retracted, door releasing position.
Figure 15:
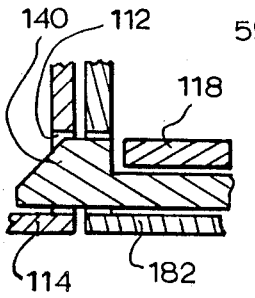
FIG. 15 is a section taken along line 15—15 of FIG. 4*a*.
Figure 13:
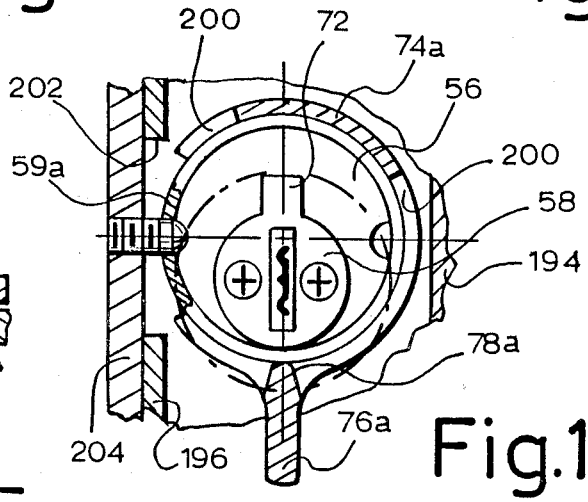
FIG. 13 is an enlarged vertical sectional partial view of the patio door sash of FIGS. 11 or 12, with the door lock annular member being in an intermediate position.

Due to the restricted angle of rotation of arm 76*a* as compared to arm 76, Y notch 80*a* is not symmetrical: its inclined side 80*c* is more inclined then inclined side 80*a* so that both sides are normal to arm 76*a* in the door locking and unlocking position. Therefore, bolt 40*a* is positively maintained by arm 76*a* in either position. FIG. 11 shows bolt 40*a* in advanced, door locking position, protruding through a bolt hole of patio door frame 208.

In the claims, the term "annular member" includes a partial annular member of the type shown in FIG. 9.

What I claim is:

1. A door locking device to be used in combination with two conventional co-axial lock cylinders each having a key-operated barrel radially offset from the center of its cylinder and rotatable therein and having an actuating radial lug at its end opposite to the key-receiving end, the two lugs adjacent each other, said device including an annular member rotatably mounted around said two cylinders and including an inner projection in the path of both actuating radial lugs and an outer radial operating arm, a bolt member, means to guide said bolt member for movement between a retracted door unlocking position and an advanced door locking position, said bolt member having a V-shaped notch continuously engaged by said operating arm throughout rotation of said annular member, said notch having a side substantially normal to said arm and engaging said arm in the advanced position of said bolt member and in the corresponding rotated position of said annular member, whereby said arm positively maintains said bolt member in advanced position while said barrels can be rotated back to a position to permit removal of keys from within said barrels.

2. The locking device as defined in claim 1, wherein said annular member has a pair of spaced external longitudinal grooves and further including a biasing member fixed to said casing, bearing against said annular member and selectively engageable in either of said grooves, in two limit positions of said arm.

3. The locking device as defined in claim 1, wherein said arm and said internal projection are in radial alignment.

4. A locking device comprising a casing defining a main wall and an outer side wall adapted to be disposed adjacent a door frame, a key lock cylinder fixed to said main wall, a barrel journalled within said key lock cylinder and radially offset from the center of the latter and including a longitudinal slit opening at one end of said barrel for removable engagement of an operating key and a radially outwardly projecting lug, carried by the other end of said barrel, an annular member rotatably mounted around said key lock cylinder, carrying an internal projection in the path of said lug and a radially outwardly extending operating arm, rotation of said barrel by said key in one direction causing said lug to abut said projection and rotate said annular member, and further including a bolt member mounted in said casing for guided linear movement through said side wall between a retracted, door unlocking position and an advanced door locking position, said bolt member having a Y-shaped notch continuously engaged by said arm throughout rotation of said annular member, said notch having a side substantially normal to said arm and engaging said arm in the advanced position of said bolt member and in the corresponding rotated position of said annular member, whereby said arm positively maintains said bolt member in advanced position while said barrel can be rotated back to a position to release said key from said slit, and further including a door latch and an actuating arm both carried by said casing, said actuating arm pivotable in said casing by rotation of a door handle, means to guide the door latch within said casing for linear movement between an advanced and a retracted position, biasing means to bias said door latch to advanced position, a tab carried by said door latch, a hook lever pivoted in said casing and engageable with said tab to retract said door latch against the bias of said biasing means, a notched lever pivoted to said hook lever and having a notch engageable by said actuating arm in a first pivoted position of said notched lever, whereby rotation of said actuating arm, when said notched lever is in said first position, displaces said notched lever to pivot said hook lever and retract the latch, second biasing means to resiliently maintain said notched lever in said first position and a link member mounted transverse to said bolt member and movable with said bolt member, between retracted and advanced positions, said link member engageable with said hook lever to pivot the same from said first position to a second pivoted position in the advanced position of said bolt member to thereby clear said actuating arm from engagement within the notch of said notched lever, whereby rotation of said actuating arm by said door handle can no longer retract said door latch.

5. The door locking device as defined in claim 4, wherein said latch member has an inwardly facing step and said link member engages said step in its advanced position to prevent retraction of said latch member.

6. The locking device as defined in claim 5, wherein said bolt member has a transverse groove and said link member is mounted within said groove for axial movement transverse to said bolt member, and further including a pair of spaced parallelogram linkage levers pivotally mounted on said link member and on said casing to allow advancing and retracting movement of said link member by said bolt member while maintaining said link member parallel to itself during its axial movement and further including hook shaped bolts carried by the outer ends of said link member and protruding from said casing outer side wall in advanced position of said bolt member and retracted within said casing in the retracted position of said bolt member.

7. A locking device comprising a casing defining a main wall and an outer side wall adapted to be disposed adjacent a door frame, a key lock cylinder fixed to said main wall, a barrel journalled within said key lock cylinder and radially offset from the center of the latter and including a longitudinal slit opening at one end of said barrel for removable engagement of an operating key and a radially outwardly projecting lug, carried by the other end of said barrel, an annular member rotatably mounted around said key lock cylinder, carrying an internal projection in the path of said lug and a radially outwardly extending operating arm, rotation of said barrel by said key in one direction causing said lug to abut said projection and rotate said annular member, and further including a bolt member mounted in side casing for guided linear movement through said side wall between a retracted, door unlocking position and an advanced door locking position, said bolt member having a Y-shaped notch continuously engaged by said arm throughout rotation of said annular member, said notch having a side substantially normal to said arm and engaging said arm in the advanced position of said bolt member and in the corresponding rotated position of said annular member, whereby said arm positively maintains said bolt member in advanced position while said barrel can be rotated back to a position to release said key from said slit, and wherein said bolt member has a trasverse groove, a straight link member mounted within said groove for axial movement transverse to said bolt member, a pair of spaced parallelogram linkage levers, pivoted at one end to said link member and at the other end to said casing, and causing axial movement of said link member transverse to said bolt during linear movement of said bolt member, and hooked shaped bolt members carried by the outer ends of said link member and taking an advanced door locking position in the advanced door locking position of said bolt member and a retracted door unlocking position in the retracted door unlocking position of said bolt member.

* * * * *